US008881559B1

(12) United States Patent
Chang

(10) Patent No.: US 8,881,559 B1
(45) Date of Patent: Nov. 11, 2014

(54) FOLDABLE LOCK

(71) Applicant: Vulcan Sports Co., Ltd., Changhua (TW)

(72) Inventor: Chin Shu Chang, Changhua (TW)

(73) Assignee: Vulcan Sports Co., Ltd., Changhua (TW)

( * ) Notice: Subject to any disclaimer, the term of this patent is extended or adjusted under 35 U.S.C. 154(b) by 0 days.

(21) Appl. No.: 14/263,973

(22) Filed: Apr. 28, 2014

(51) Int. Cl.
*E05B 67/06* (2006.01)
*E05B 73/00* (2006.01)

(52) U.S. Cl.
CPC ..... *E05B 73/0005* (2013.01)
USPC ..... 70/49; 70/14; 70/18; 70/30; 70/53; 70/233

(58) Field of Classification Search
CPC ..... E05B 73/0005; E05B 73/0082; E05B 67/003; E05B 71/00; E05B 73/00; E05B 53/003; E05B 15/002; E05B 17/2034; E05B 37/025; E05B 63/0056; E05B 17/183
USPC ..... 70/14, 18, 19, 30, 49, 53, 233
See application file for complete search history.

(56) References Cited

U.S. PATENT DOCUMENTS

| | | | | | |
|---|---|---|---|---|---|
| 3,747,376 | A * | 7/1973 | White, Jr. | ..... | 70/18 |
| 3,933,015 | A * | 1/1976 | Balicki | ..... | 70/49 |
| 4,760,718 | A * | 8/1988 | Muramatsu et al. | ..... | 70/18 |
| 5,475,993 | A * | 12/1995 | Kuo | ..... | 70/18 |
| 5,487,285 | A * | 1/1996 | Leichel et al. | ..... | 70/18 |
| 5,732,577 | A * | 3/1998 | Okada et al. | ..... | 70/18 |
| 5,896,762 | A * | 4/1999 | Iidaka et al. | ..... | 70/57.1 |
| 5,913,906 | A * | 6/1999 | Strocchi | ..... | 70/18 |
| 6,820,448 | B1 * | 11/2004 | Hsieh | ..... | 70/18 |
| 7,437,898 | B2 * | 10/2008 | Su | ..... | 70/14 |
| D579,756 | S * | 11/2008 | Hentschel et al. | ..... | D8/331 |
| 7,481,084 | B1 * | 1/2009 | Wu | ..... | 70/18 |
| 7,712,339 | B2 * | 5/2010 | Hentschel et al. | ..... | 70/30 |
| 8,156,772 | B2 * | 4/2012 | Buhl et al. | ..... | 70/49 |
| 8,418,513 | B2 * | 4/2013 | Buhl et al. | ..... | 70/49 |
| 8,621,898 | B2 * | 1/2014 | Chen | ..... | 70/18 |
| 2014/0060126 | A1 * | 3/2014 | Stevens | ..... | 70/18 |

* cited by examiner

*Primary Examiner* — Suzanne Barrett
(74) *Attorney, Agent, or Firm* — Guice Patents PLLC

(57) ABSTRACT

The present invention discloses a foldable lock. The foldable lock is constituted by a lock head which is pivoted with a foldable lock rod set. Two steel balls are used by the lock head to control unlocking and locking operations, thereby improving difficulty in prizing. The foldable lock rod set is composed of plural flexible lock rods, plural pivoting sheaths, plural protective covers and plural bolts, allowing the foldable lock to have a better circuity when twining an object. By the abovementioned structures, the foldable lock can increase convenience in the locking operation and enhance the anti-theft effect.

9 Claims, 10 Drawing Sheets

FOLDABLE LOCK

BACKGROUND OF THE INVENTION a) Field of the Invention

The present invention relates to a foldable lock and more particularly to a foldable lock which is provided with a better circuity when twining an object, thereby increasing convenience in locking with that foldable lock and enhancing the anti-theft effect.

b) Description of the Prior Art

Referring to FIG. 1, it shows a schematic view of an unfolded conventional foldable lock 1, wherein the foldable lock 1 includes primarily a lock head 13 and plural lock rods 11 pivoted with the lock head 13, with that a pivoting element 12 is used to connect between every two lock rods 11. This kind of structure is advantageous in that it can be collected easily without taking up space; therefore, it is often used as a bicycle lock. However, there exists one issue in using this foldable lock 1; as the lock rods 11 of the foldable lock 1 are made of a rigid material, they can only be unfolded outward along a straight line, and if there is some bend on the route along which the object (e.g., bicycle) is twined, then the locking operation will not be accomplished successfully. At this time, a user can only readjust the position and angle of twining, and this is rather inconvenient. In addition, the lock head 13 of the conventional foldable lock 1 mostly adopts the structure of a U-lock of a bicycle, but it is well known that the anti-prizing effect of the U-lock is not perfect, which affects significantly the use of the foldable lock 1.

SUMMARY OF THE INVENTION

Accordingly, the primary object of the present invention is to provide a foldable lock which is provided with a better circuity when twining an object, thereby increasing convenience in locking with that foldable lock and enhancing the anti-theft effect.

To achieve the aforementioned object, a foldable lock of the present invention is formed by a lock head which is pivoted with a foldable lock rod set. The lock head includes:

an outer shell, a side of an inner surface of the outer shell is provided with an upper installation base, the other side of the inner surface is parallel distributed with a first container slot, a middle container slot and a second container slot, a first separator is disposed between the first container slot and the middle container slot and is provided with a right semi-circular slot, a second separator is disposed between the second container slot and the middle container slot and is provided with a left semi-circular slot which corresponds to the right semi-circular slot, the first container slot is provided with a first guide rail, the second container slot is provided with a second guide rail, the middle container slot is provided with a middle guide rail, and an end of the outer shell is pivoted with the foldable lock rod set;

a bottom shell, the bottom shell is locked at bottom of the outer shell, a side of an inner surface of the bottom shell is provided with a lower installation base, the other side of the inner surface is provided with a first lower container slot and a second lower container slot, the first lower container slot corresponds to the first container slot, and the second lower container slot corresponds to the second container;

a lock body, the lock body is disposed at a location where the upper installation base splits with the lower installation base, and is formed by a lock core and a lock base, with that an end of the lock core is provided with a key hole and the other end is provided with a convex axle;

a lock bolt base, a side of the lock bolt base is provided with a lock bolt, the lock bolt is provided with a through-hole, and the other side of the lock bolt base is pivoted with the foldable lock rod set;

a lower sliding base, a rear side of the lower sliding base is provided with a left sliding block and a right sliding block, a center at a front side of the lower sliding base is provided with a front sliding block, the left sliding block is disposed between the second container slot and the second lower container slot, an inner side of the left sliding block is concaved with an arc-shaped slot, a top of the left sliding block is provided with a second spring slot and a second guide slot, the second spring slot contains a second spring, the second guide slot is latched with the second guide rail, the right sliding block is disposed between the first container slot and the first lower container slot, an inner side of the right sliding block is concaved with an arc-shaped slot, a top of the right sliding block is provided with a first spring slot and a first guide slot, the first spring slot contains a first spring, the first guide slot is latched with the first guide rail, and a top of the front sliding block is provided with a sheathing slot which provides for sheathing with the convex axle of the lock core;

two steel balls, the two steel balls are forced to move by the lower sliding base, sliding in the arc-shaped slots, the right semi-circular slot, the left semi-circular slot and the through-hole of the lock bolt base; and an upper sliding block, a top of the upper sliding block is provided with a third spring slot and a third guide slot, the third spring slot contains a third spring, and the third guide slot is latched with the middle guide rail.

The foldable lock rod set is composed of plural lock rods, plural pivoting sheaths, plural protective covers and plural bolts, wherein the lock rod is made of a flexible and elastic material and two ends of the lock rod are provided respectively with a joint section;

a side of the pivoting sheath is provided with a first sheathing section, the first sheathing section is provided at least with a first sheathing hole for insertion and fixing with the joint section, and the other side of the pivoting sheath is provided with a first pivoting section which contains a first perforation;

the protective cover is sheathed outside the pivoting sheath, a side of the protective cover is provided with a second sheathing section which contains a second sheathing hole for insertion and fixing with the pivoting sheath, and the other side of the protective cover is provided with a second pivoting section which contains a second perforation; and the bolt is transfixed into the first sheathing hole and the second sheathing hole to pivot together two ends of every front and rear neighboring lock rod and to pivot an end of the lock rod with the lock head.

A periphery of an inner surface of the abovementioned outer shell is provided with plural locking pillars.

A periphery of an inner surface of the abovementioned bottom shell is provided with plural locking holes.

The abovementioned key hole is laterally connected with plural bead grooves, and each bead groove is provided with a spring and a bead column.

A top of the abovementioned upper installation base is formed with a round hole at the outer shell.

An end of the abovementioned outer shell, pivoting with the foldable lock rod set, is provided with a notch; whereas, two sides of the notch are provided respectively with a corresponding latching hole.

The other side of the abovementioned lock bolt base is pivoted with the foldable lock rod set, the lock bolt base is provided with a notch and two sides of the notch are provided respectively with a corresponding latching hole.

The abovementioned lock rod is constituted by at least a metallic wire enclosed by an outer layer (the metallic wire is a steel cord).

Two ends of the abovementioned metallic wire are protruded respectively out of an end part of the outer layer, forming a joint section.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
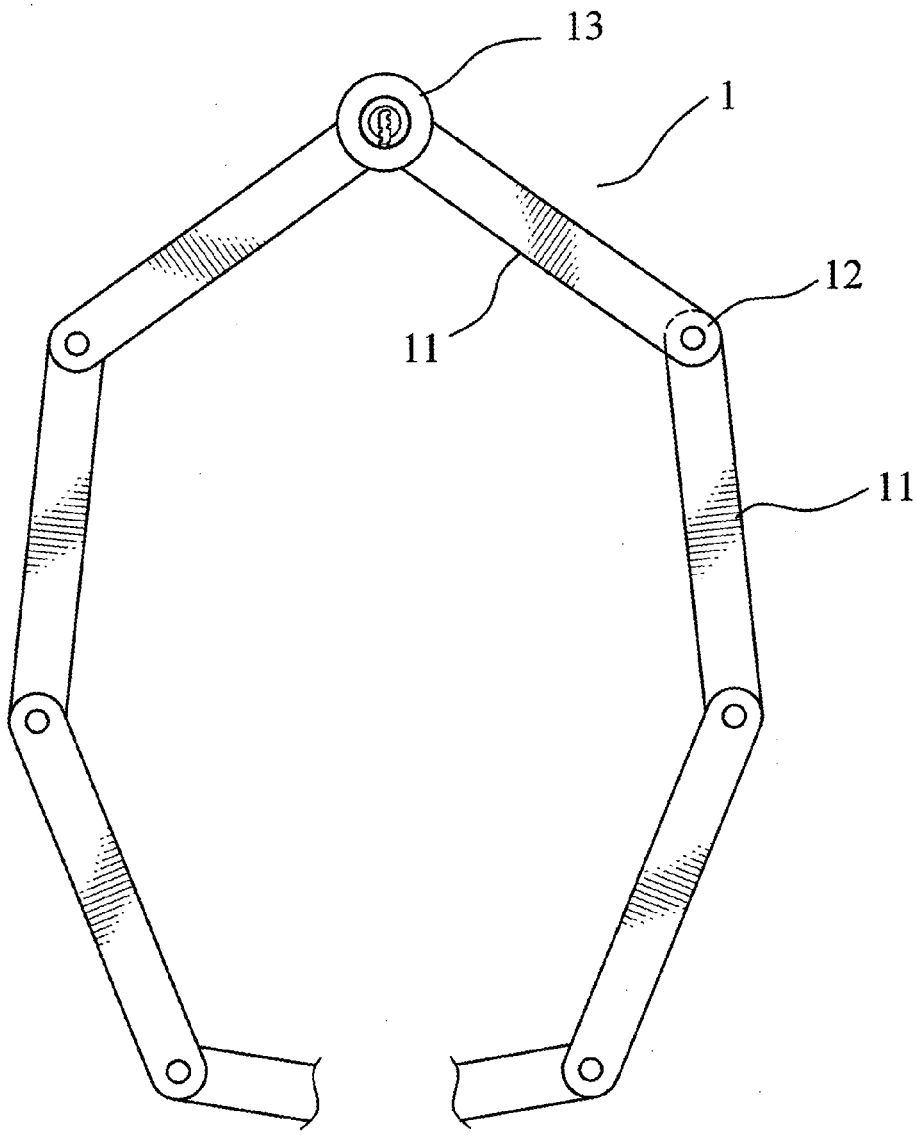
FIG. 1 PRIOR ART
FIG. 1 shows a schematic view of an unfolded conventional foldable lock.
Figure 2:
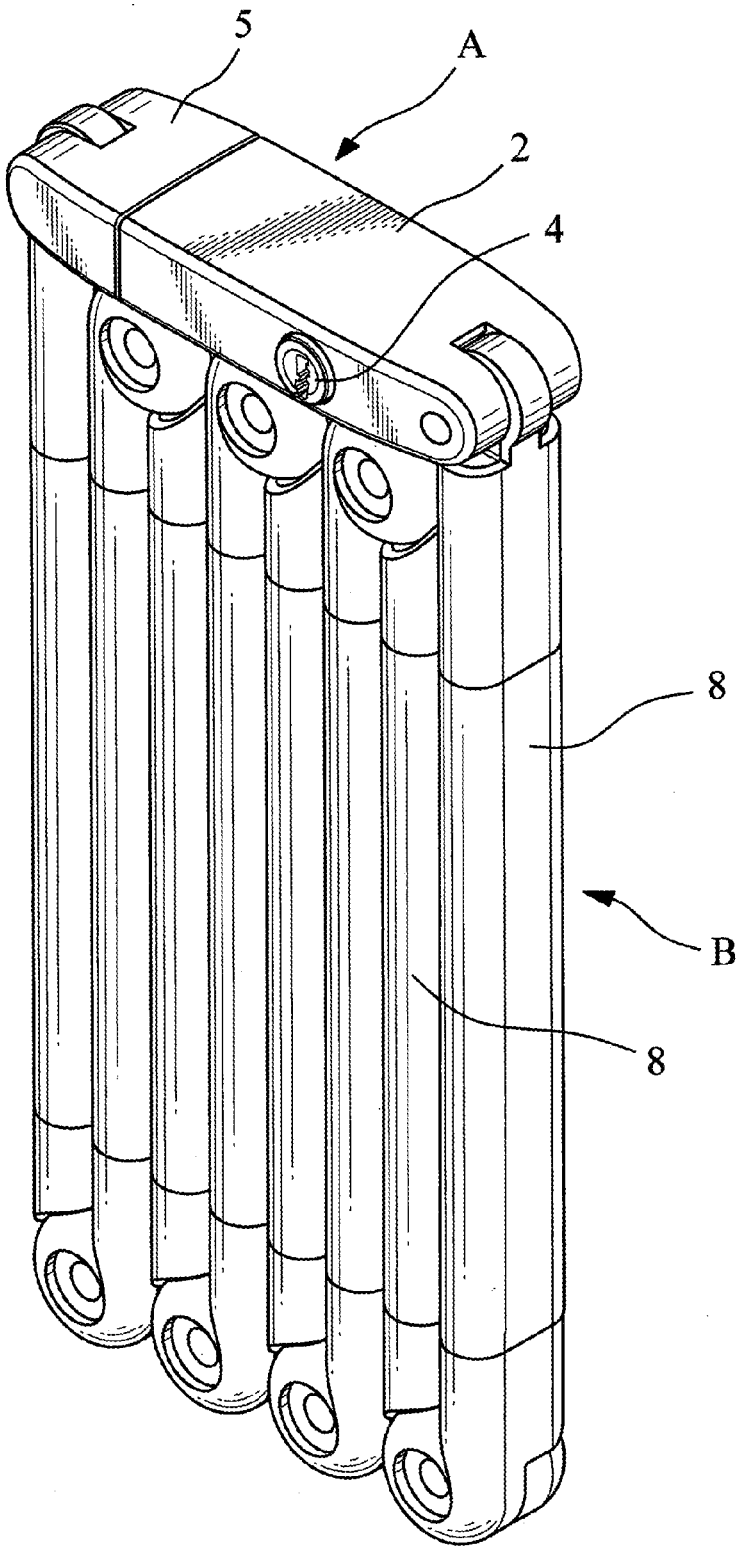
FIG. 2 shows a three-dimensional view of the present invention.
Figure 3:
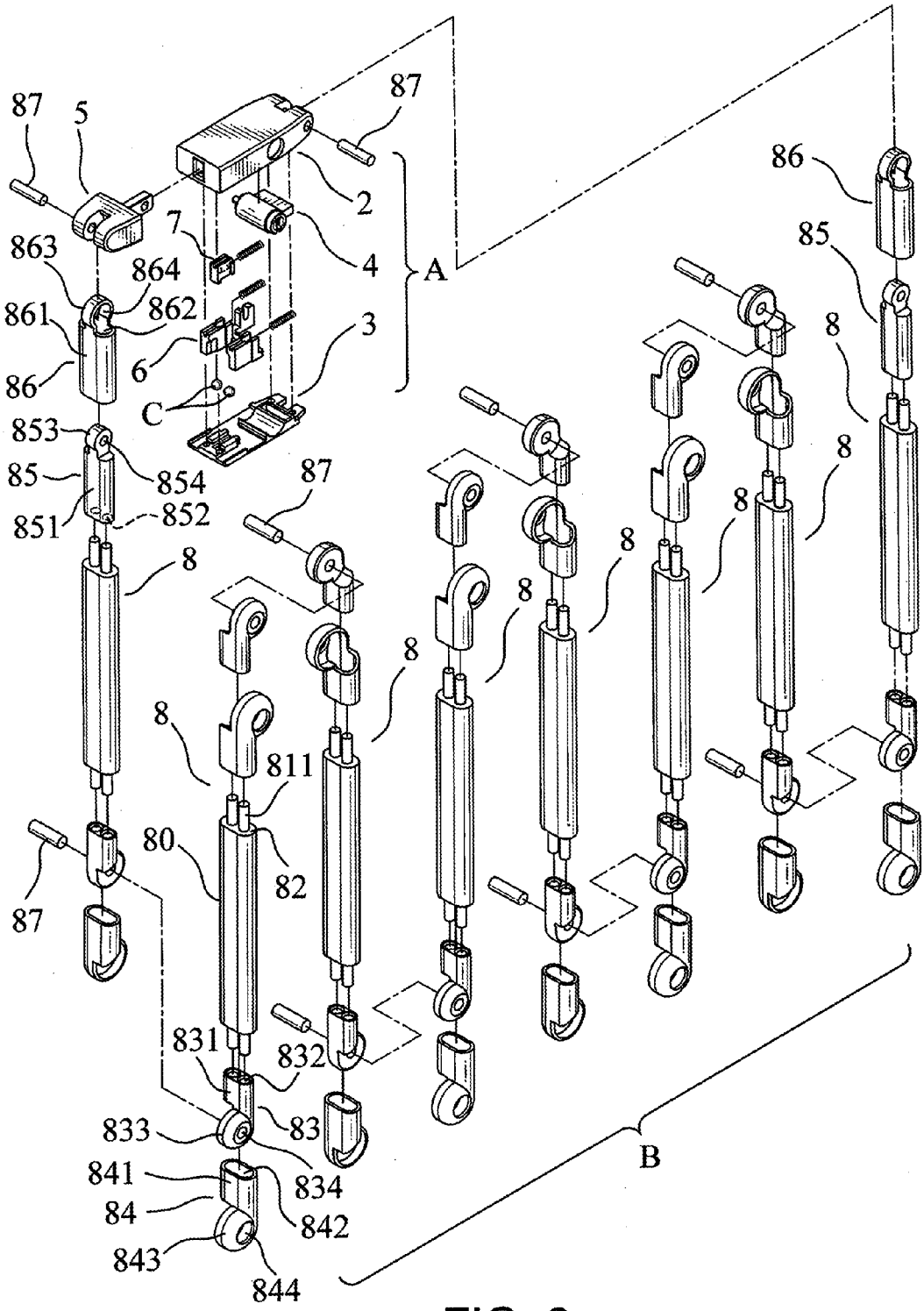
FIG. 3 shows a three-dimensional exploded view of the present invention.
Figure 4:
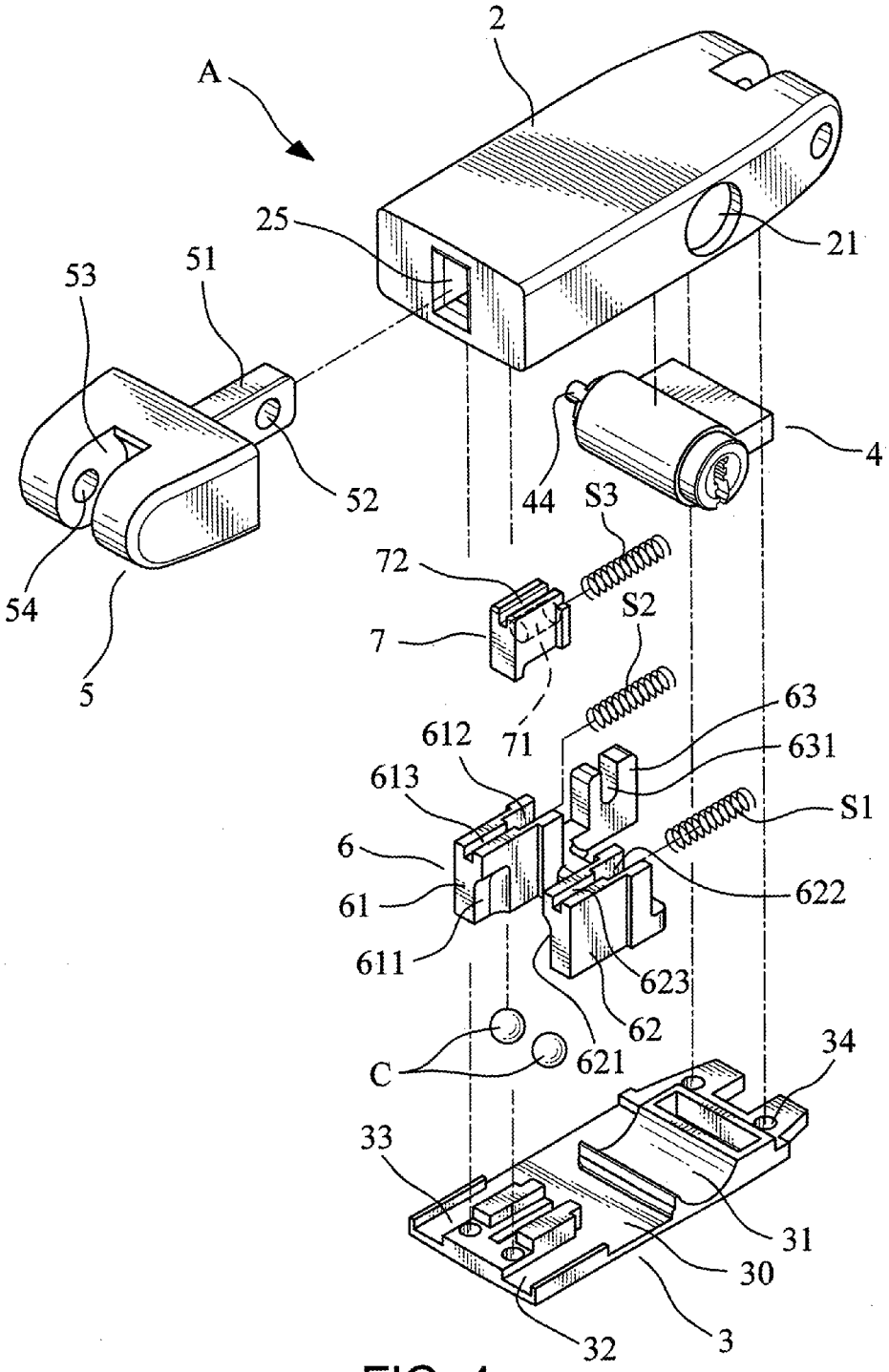
FIG. 4 shows a three-dimensional exploded view of a lock head of the present invention.
Figure 5:
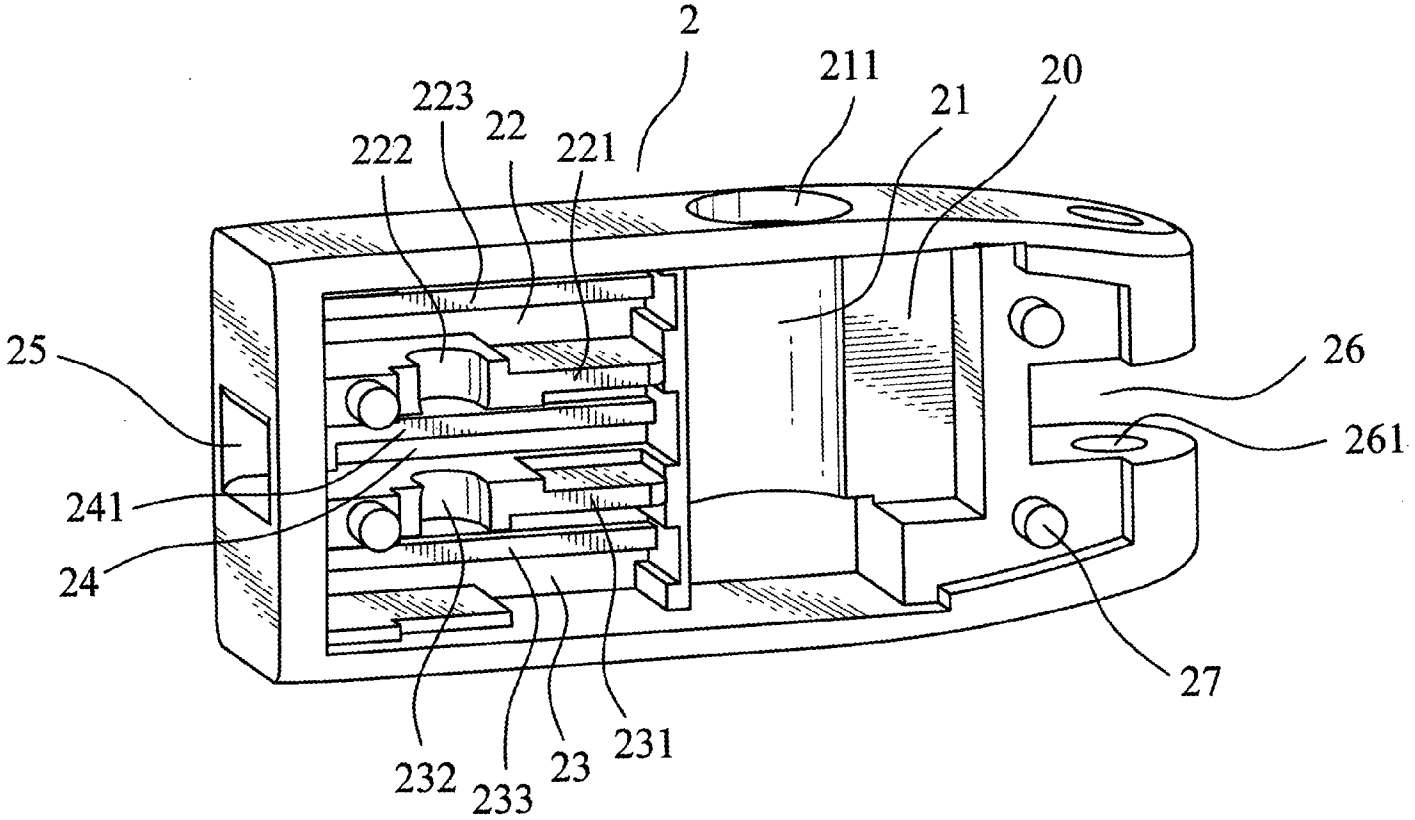
FIG. 5 shows a three-dimensional view of an outer shell of the present invention.

Referring to FIGS. 2 to 7, a foldable lock of the present invention comprises a lock head A which is pivoted with a foldable lock rod set B.

The lock head A includes an outer shell 2, a bottom shell 3, a lock body 4, a lock bolt base 5, a lower sliding base 6, two steel balls C and an upper sliding block 7.

A side of an inner surface 20 of the outer shell 2 is provided with an upper installation base 21. A top of the upper installation base 21 is formed with a round hole 211 at the outer shell 2. The other side of the inner surface 20 is parallel distributed with a first container slot 22, a middle container slot 24 and a second container slot 23. A first separator 221 is disposed between the first container slot 22 and the middle container slot 24, and is provided with a right semi-circular slot 222; whereas a second separator 231 is disposed between the second container slot 23 and the middle container slot 24, and is provided with a left semi-circular slot 232 which corresponds to the right semi-circular slot 222. An interior of the first container slot 22 is provided with a first guide rail 223 and an interior of the second container slot 23 is provided with a second guide rail 233; whereas, an interior of the middle container slot 24 is provided with a middle guide rail 241. An end of the outer shell 2 is provided with a notch 26, and two sides of the notch 26 are provided respectively with a corresponding latching hole 261; whereas, the other end of the outer shell 2 is provided with a lock bolt insertion hole 25, and a periphery of the inner surface 20 is provided with plural locking pillars 27.

The bottom shell 3 is locked at bottom of the outer shell 2, and a side of an inner surface 30 of the bottom shell 3 is provided with a lower installation base 31 which splits with the upper installation base 21. The other side of the inner surface 30 is provided with a first lower container slot 32 and a second lower container slot 33, the first lower container slot 32 corresponds to the first container slot 22, and the second lower container slot 33 corresponds to the second container slot 23. A periphery of the inner surface 30 is provided with plural locking holes 34 which are locked correspondingly with the locking pillars 27.

The lock body 4 is disposed at a position where the upper installation base 21 splits with the lower installation base 31, and is formed by a lock core 40 and a lock base 41. An end of the lock core 40 is provided with a key hole 401, and the other end of the lock core 40 is provided with a convex axle 44. The key hole 401 is laterally connected with plural bead grooves 402, and each bead groove 402 contains a spring 42 and a bead column 43.

A side of the lock bolt base 5 is provided with a lock bolt 51 which contains a through-hole 52; whereas, the other side of the lock bolt base 5 is provided with a notch 53, and two sides of the notch 53 are provided respectively with a correspondingly a latching hole 54.

A rear side of the lower sliding base 6 is provided with a left sliding block 61 and a right sliding block 62. A center at a front side of the lower sliding base 6 is provided with a front sliding block 63, and the left sliding block 61 is disposed between the second container slot 23 and the second lower container slot 33. An inner side of the left sliding block 61 is concaved with an arc-shaped slot 611, and a top of the left sliding block 61 is provided with a second spring slot 612 and a second guide slot 613. The second spring slot 612 contains a second spring S2, and the second guide slot 613 is latched with the second guide rail 233. The right sliding block 62 is disposed between the first container slot 22 and the first lower container slot 32, and an inner side of the right sliding block 62 is concaved with an arc-shaped slot 621. A top of the right sliding block 62 is provided with a first spring slot 622 and a first guide slot 623. The first spring slot 622 contains a first spring S1, and the first guide slot 623 is latched with the first guide rail 223. A top of the front sliding block 63 is provided with a sheathing slot 631 which provides for sheathing and linking with the convex axle 44 of the lock core 40.

The steel balls C are forced to move by the lower sliding base 6, sliding in the arc-shaped slots 611, 621, the right semi-circular slot 222, the left semi-circular slot 232 and the through-hole 52 of the lock bolt base 5.

A top of the upper sliding block 7 is provided with a third spring slot 71 and a third guide slot 72. The third spring slot 71 contains a third spring S3, and the third guide slot 72 is latched with the middle guide rail 241.

The foldable lock rod set B is formed by plural lock rods 8, plural pivoting sheaths 83, 85, plural protective covers 84, 86 and plural bolts 87 (as shown in FIGS. 3, 8, 9 and 10).

The lock rod 8 is made of a flexible and elastic material, constituted by at least a metallic wire 81 enclosed by an outer layer 82. Two ends of the metallic wire 81 are protruded out of two ends of the outer layer 82, forming a joint section 811.

A side of the pivoting sheath 83, 85 is provided with a first sheathing section 831, 851. The first sheathing section 831, 851 is provided at least with a first sheath hole 832, 852 for insertion and fixing with the joint section 811. The other side of the pivoting sheath 83, 85 is provided with a first pivoting section 833, 853 which contains a first perforation 834, 854.

The protective cover 84, 86 is sheathed outside the pivoting sheath 83, 85. A side of the protective cover 84, 86 is provided with a second sheathing section 841, 861 which is provided with a second sheath hole 842, 862 for insertion and fixing with the pivoting sheath 83, 85. The other side of the protective cover 84, 86 is provided with a second pivoting section 843, 863 which is provided with a second perforation 844, 864.

The bolts 87 are transfixed into the first perforations 834, 854 and the second perforations 844, 864, pivoting together two ends of every front and rear neighboring lock rod 8, and pivoting one end of the lock rod 8 with the lock head A.

Figure 6:
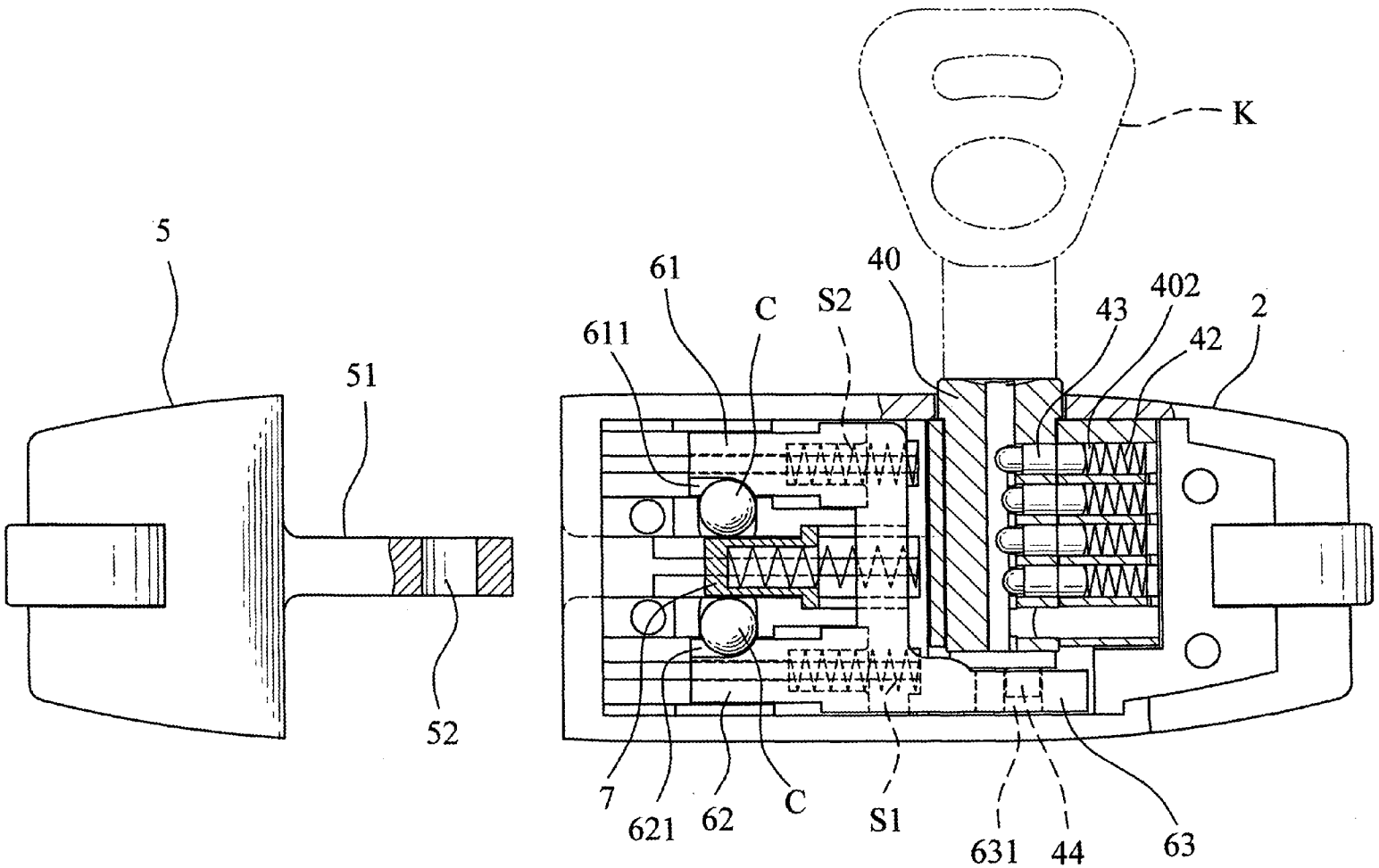
FIG. 6 shows a schematic view of the present invention in an unlocking state.
Figure 7:
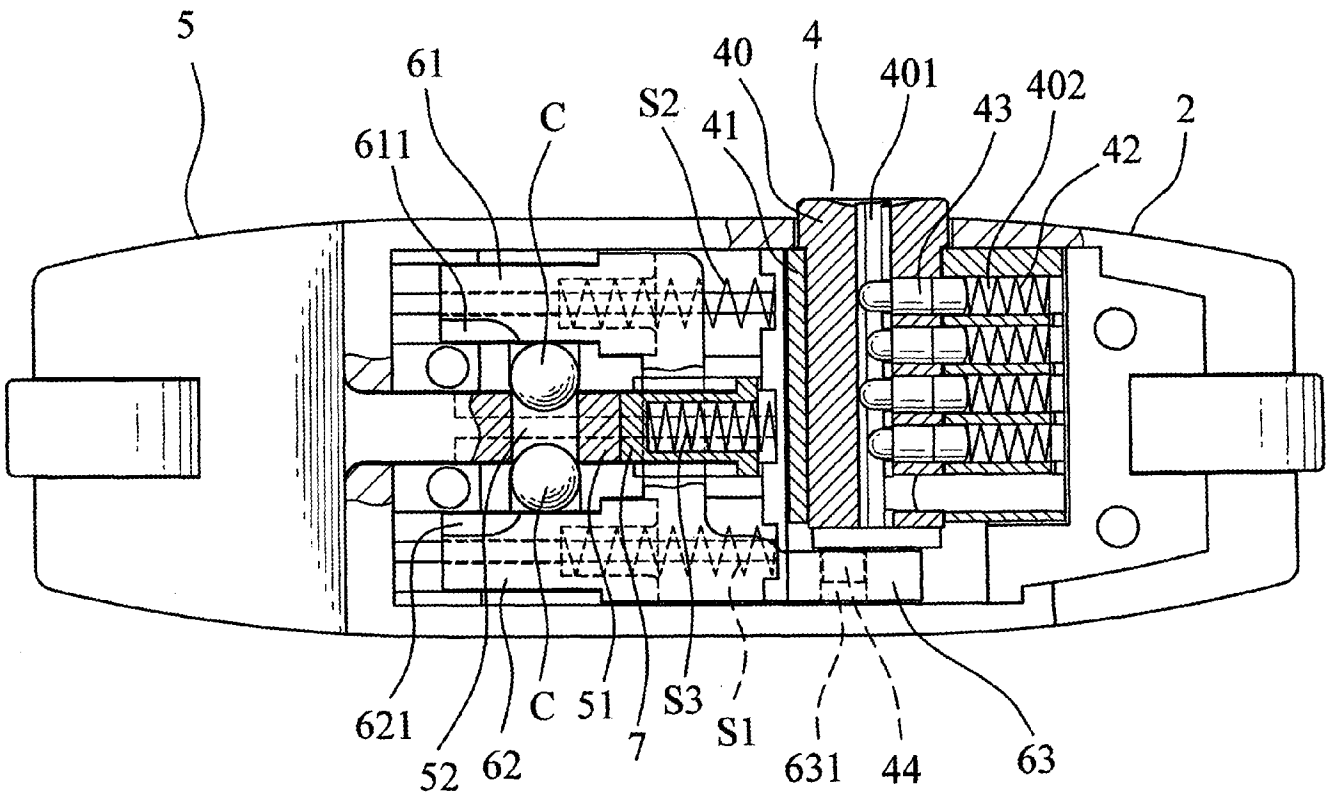
FIG. 7 shows a schematic view of the present invention in a locking state.
Figure 11:
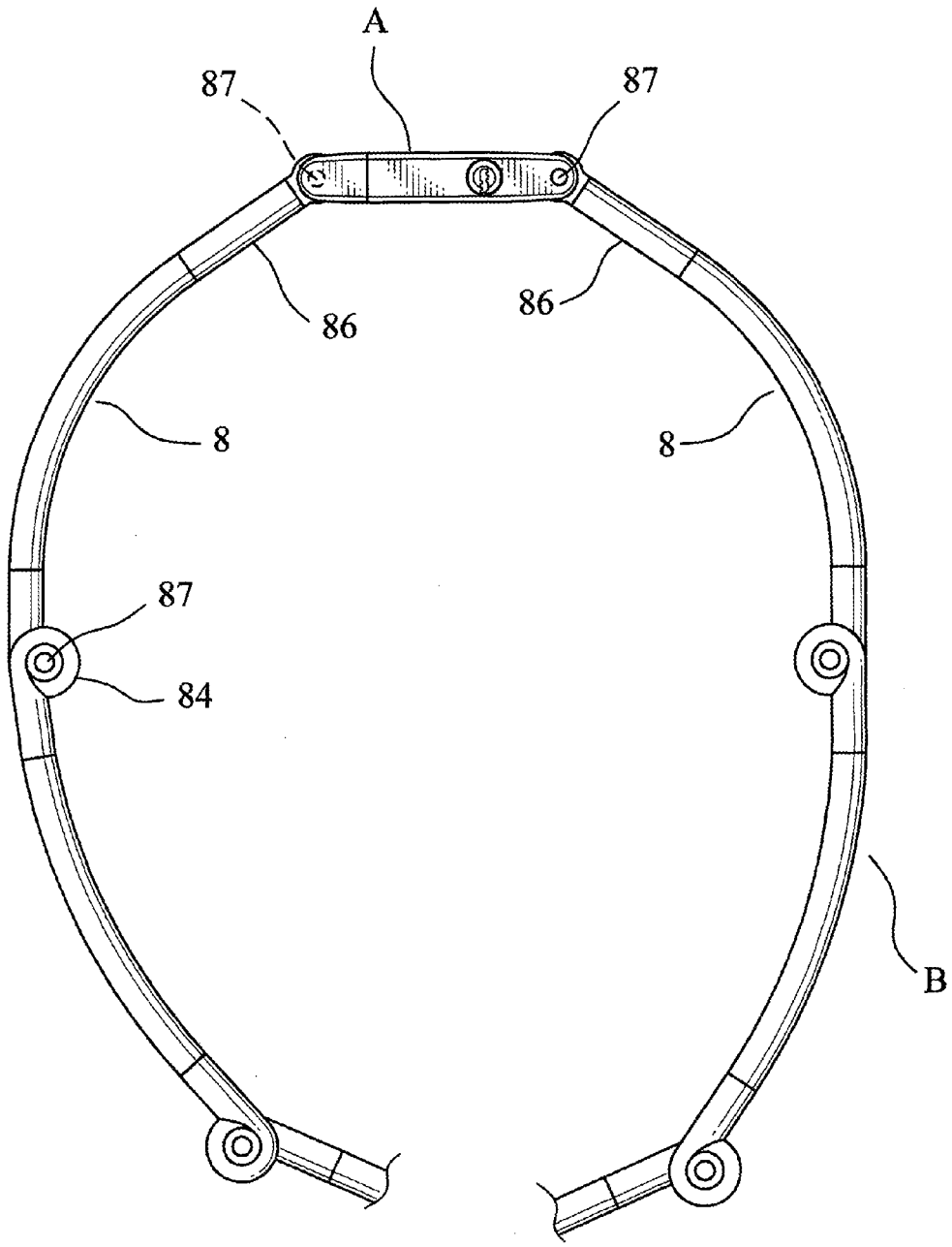
FIG. 11 shows a schematic view of the present invention that is unfolded.

By the abovementioned elements, when locking an object (e.g. bicycle), each lock rod 8 of the foldable lock rod set B is first unfolded outward one by one (as shown in FIG. 11), the object is then twined by an end of the lock rod 8 connecting the lock bolt base 5, the lock bolt 51 of the lock bolt base 5 is next inserted into the lock bolt insertion hole 25 of the lock head A, the upper sliding block 7 is pushed forward to compress the third spring S3, and the steel balls C are forced into the through-hole 52 of the lock bolt 51. At this time, the lock core 40 is rotated by a key K to lock. When the lock core 40 rotates, the convex axle 44 that is sheathed in the sheathing slot 631 of the front sliding block 63 will drive and push the lower sliding base 6 outward, and the first spring S1 and the second spring S2 will no longer be compressed and will increase a force that pushes the lower sliding base 6 outward with elasticity. On the other hand, the arc-shaped slots 611, 621 will close the steel balls C in the through-hole 52 due to displacement, and then the key K is withdrawn from the key hole 401, thereby accomplishing the locking operation (as shown in FIG. 6 and FIG. 7).

Figure 8:
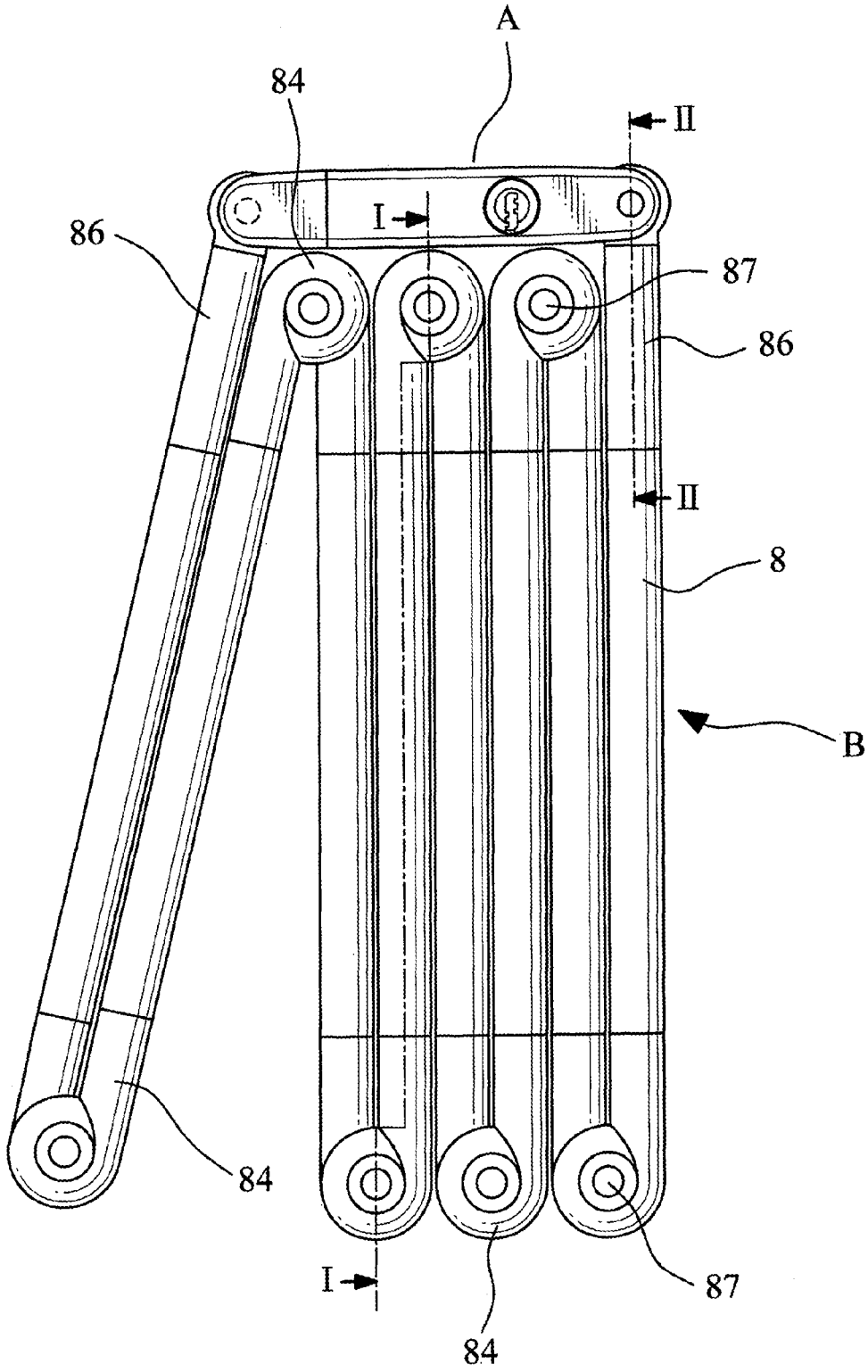
FIG. 8 shows a plan view of the present invention.
Figure 9:
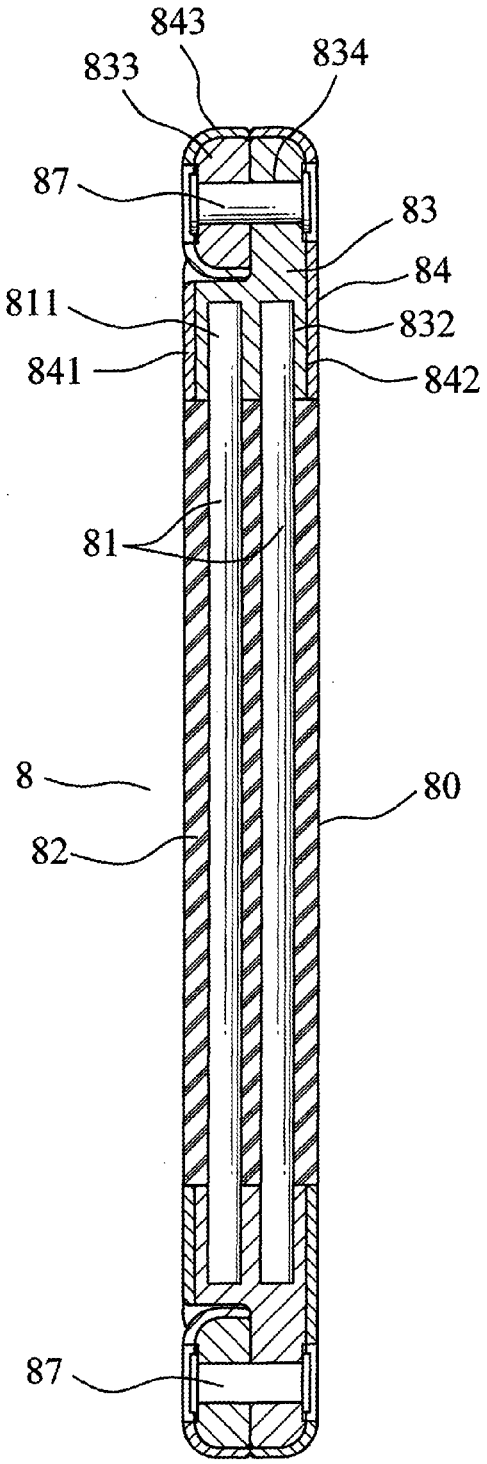
FIG. 9 shows a cutaway view along a line I-I in FIG. 8.
Figure 10:
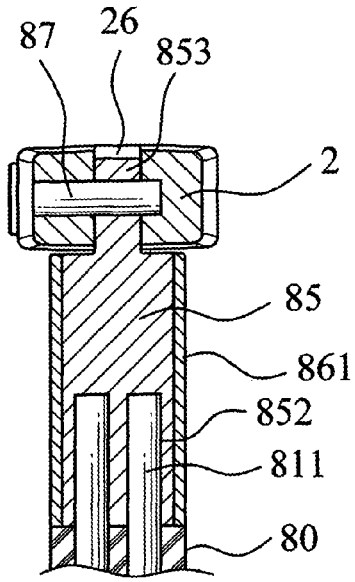
FIG. 10 shows a local cutaway view of the lock head assembled with the lock rods of the present invention.

When unlocking the object, the key K is first inserted into the key hole 401 to rotate the lock core 40. When the lock core 40 rotates, the convex axle 44 that is sheathed in the sheathing slot 631 of the front sliding block 63 will drive the lower sliding base 6 to move inward and compress the first spring S1 and the second spring S2 to indent, and by the guidance of the arc-shaped slots 611, 621, the steel balls C will not clamp the upper sliding block 7. The third spring S3 will push the lock bolt base 5 outward with elasticity, enabling the lock bolt base 5 to escape from the lock bolt insertion hole 25 of the lock head A, which accomplishes the unlocking operation. Next, each lock rod 8 of the foldable lock rod set B is folded inward one by one (as shown in FIG. 8) to facilitate collecting.

When assembling the foldable lock rod set B, according to the present invention, the joint section 811 of each lock rod 8 is first inserted into the pivoting sheath 83, 85 and then sheathed into the protective cover 84, 86, enabling the first perforation 834, 854 to be located at a corresponding position of the second perforation 844, 864. The protective cover 84, 86 will enclose the pivoting sheath 83, 85, and then an end of two neighboring lock rods 8 is folded with respect to each other. Next, the bolt 87 is transfixed into the first perforation 834 and the second perforation 844, and the lock rods 8 are then riveted and pivoted. Furthermore, the first perforation 854 and the second perforation 864 at an end of the outermost lock rod 8 of the foldable lock rod set B, pivoting with the lock head A, are aligned with the latching hole 261 of the outer shell 2 and the latching hole 54 of the lock bolt base 5. The bolt 87 is then transfixed, and the outermost lock rod 8, the outer shell 2 and the lock bolt base 5 are riveted and pivoted. In addition, a rotatable pivoting point can be formed to unfold outward or collect inward the foldable lock rod set B.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A foldable lock comprising a lock head which is pivoted with a foldable lock rod set, wherein the lock head includes:

an outer shell, a side of an inner surface of the outer shell is provided with an upper installation base, the other side of the inner surface is parallel distributed with a first container slot, a middle container slot and a second container slot, a first separator is disposed between the first container slot and the middle container slot and is provided with a right semi-circular slot, a second separator is disposed between the second container slot and the middle container slot and is provided with a left semi-circular slot corresponding to the right semi-circular slot, the first container slot is provided with a first guide rail, the second container slot is provided with a second guide rail, the middle container slot is provided with a middle guide rail, and an end of the outer shell is pivoted with the foldable lock rod set;

a bottom shell, the bottom shell is locked at bottom of the outer shell, a side of an inner surface of the bottom shell is provided with a lower installation base, the other side of the inner surface is provided with a first lower container slot and a second lower container slot, the first lower container slot corresponds to the first container slot, and the second lower container slot corresponds to the second container slot;

a lock body, the lock body is disposed at a location where the upper installation base splits with the lower installation base, and is formed by a lock core and a lock base, with that an end of the lock core is provided with a key hole and the other end is provided with a convex axle;

a lock bolt base, a side of the lock bolt base is provided with a lock bolt, the lock bolt is provided with a through-hole, and the other side of the lock bolt base is pivoted with the foldable lock rod set;

a lower sliding base, a rear side of the lower sliding base is provided with a left sliding block and a right sliding block, a center at a front side of the lower sliding base is provided with a front sliding block, the left sliding block is disposed between the second container slot and the second lower container slot, an inner side of the left sliding block is concaved with an arc-shaped slot, a top of the left sliding block is provided with a second spring slot and a second guide slot, the second spring slot contains a second spring, the second guide slot is latched with the second guide rail, the right sliding block is disposed between the first container slot and the first lower container slot, an inner side of the right sliding block is concaved with an arc-shaped slot, a top of the right sliding block is provided with a first spring slot and a first guide slot, the first spring slot contains a first spring, the first guide slot is latched with the first guide rail, and a top of the front sliding block is provided with a sheathing slot which provides for sheathing with the convex axle of the lock core;

two steel balls, the two steel balls are forced to move by the lower sliding base, sliding in the arc-shaped slots, the right semi-circular slot, the left semi-circular slot and the through-hole of the lock bolt base; and an upper sliding block, a top of the upper sliding block is provided with a third spring slot and a third guide slot, the third spring slot contains a third spring, and the third guide slot is latched with the middle guide rail; and the foldable lock rod set is composed of a plurality of lock rods, a plurality of pivoting sheaths, a plurality of protective covers and a plurality of bolts, wherein each of the plurality of lock rods is comprised of a flexible and elastic material having two ends, each end of the lock rod is provided respectively with a joint section;

each of the plurality of pivoting sheaths comprises a first end and a second end, the first end is provided with a first sheathing section, the first sheathing section is provided at least with a first sheathing hole for insertion and fixing with the joint section, and the second end of the pivoting sheath is provided with a first pivoting section which contains a first perforation;

each of the plurality of protective covers is sheathed outside of each pivoting sheath and comprises a first end and a second end, the first end of the protective cover is provided with a second sheathing section which contains a second sheathing hole for insertion and fixing with the pivoting sheath, and the second end of the protective cover is provided with a second pivoting section which contains a second perforation; and each of the plurality of bolts is transfixed into each said first sheathing hole and each said second sheathing hole to pivot together two ends of every front and rear neighboring lock rod and to pivot an end of each said lock rod with the lock head.

2. The foldable lock according to claim 1, wherein a periphery of an inner surface of the outer shell is provided with plural locking pillars.

3. The foldable lock according to claim 1, wherein a periphery of an inner surface of the bottom shell is provided with plural locking holes.

4. The foldable lock according to claim 1, wherein the key hole is laterally connected with plural bead grooves, and each bead groove contains a spring and a bead column.

5. The foldable lock according to claim 1, wherein a top of the upper installation base is formed with a round hole at the outer shell.

6. The foldable lock according to claim 1, wherein an end of the outer shell, pivoting with the foldable lock rod set, is provided with a notch, and two sides of the notch are provided respectively with a corresponding latching hole.

7. The foldable lock according to claim 1, wherein the other side of the lock bolt base is pivoted with the foldable lock rod set, the lock bolt base is provided with a notch, and two sides of the notch are provided respectively with a corresponding latching hole.

8. The foldable lock according to claim 1, wherein each said lock rod is formed by at least a steel cord enclosed by an outer layer.

9. The foldable lock according to claim 1, wherein each said lock rod is formed by at least a metallic wire enclosed by an outer layer, and two ends of the metallic wire are protruded out of an end part of the outer layer respectively, forming a joint section.

* * * * *